United States Patent [19]

Illenberg et al.

[11] Patent Number: 4,754,272

[45] Date of Patent: Jun. 28, 1988

[54] THREE ASPECT SIGNALLING DEVICE USING NO MOVING PARTS

[75] Inventors: Cornelius J. Illenberg; Ronald J. Refici; Lynn Van Orden, all of Rochester, N.Y.

[73] Assignee: General Signal Corporation, Stamford, Conn.

[21] Appl. No.: 908,767

[22] Filed: Sep. 18, 1986 (Under 37 CFR 1.47)

[51] Int. Cl.[4] ..... G08B 5/36

[52] U.S. Cl. ..... 340/815.1; 340/50; 362/231; 350/408

[58] Field of Search ..... 340/50, 907, 815.06, 340/815.07, 815.10, 84, 111; 362/231, 236, 244, 268, 293; 350/408, 397

[56] References Cited

U.S. PATENT DOCUMENTS

| | | | |
|---|---|---|---|
| 1,219,514 | 3/1917 | Whitney | 340/815.1 X |
| 3,336,835 | 8/1967 | Evensen et al. | 362/293 X |
| 4,454,570 | 6/1984 | Morello | 362/231 |
| 4,488,207 | 12/1984 | Harmon | 362/231 |
| 4,535,394 | 8/1985 | Dugre | 362/231 |

*Primary Examiner*—Joseph A. Orsino, Jr.
*Assistant Examiner*—Brian R. Tumm
*Attorney, Agent, or Firm*—Ronald Reichman

[57] ABSTRACT

A three color aspect light signalling system that displays one color at a time without producing phantom signals. The apparatus utilizes three sources of collimated white light, a filter and two dichroic mirror/filters are used to produce three colored aspects and two output lenses are used to collimate the colored output signal so that it may be seen at distances greater than one mile.

6 Claims, 2 Drawing Sheets

THREE ASPECT SIGNALLING DEVICE USING NO MOVING PARTS

FIELD OF THE INVENTION

This invention relates to signalling devices and more particularly to multiple color aspect signalling devices.

BACKGROUND OF THE INVENTION

Description of the Prior Art

It has been common practice to use signalling lamps or lights at airports, street intersections, and/or railroads, etc. to provide information on an around-the-clock basis. Typically, three different colored signals are displayed i.e., red, yellow and green. A red signal indicated that the vehicle should stop and a yellow signal meant that the vehicle may proceed with caution. A green signal was used to inform a person or vehicle that it was safe to proceed.

The light density of the aformentioned three colored signals must be of sufficient quality so that the distinguishing color will be visible at great distances i.e., a railroad signal would have to be seen at distances greater than one mile. Reflectors were used to collimate the lamp's light so that the signal would be able to be seen at a distance that would enable a person or vehicle to stop without being injured. One of the disadvantages of the prior art was that an outside light source, such as direct sunlight or a car's headlights may produce a phantom signal by being directed onto one of the three colored signals and being reflected back out. This phantom signal could cause a potentially dangerous situation i.e., a person may be of the opinion that the signalling device is producing a green signal when the signalling device is not producing a green signal.

The prior art used one lamp for each color or one lamp and a moveable lens mechanism to produce a signal having three aspects i.e., red, yellow and green. The moveable lens mechanism was controlled by a complex series of relays which allowed the selection of the desired aspect. When no energy was applied to the relay system, the lens mechanism remained in a neutral position and a red aspect was produced. When energy of one polarity was applied to the relay system, the lens mechanism would move to produce a yellow aspect and when energy of the opposite polarity was applied to the relay system the lens mechanism would produce a green aspect.

One of the disadvantages of the single lens and moveable relay lens system was that if a vandal shot a projectile through the lamp, the lenses could be locked in one position and the signalling device would only be capable of producing one colored signal. The foregoing could lead to a potentially hazardous situation. Other disadvantages of the single lens and moveable lens system are that the relay mechanism is expensive and difficult to maintain.

SUMMARY OF THE INVENTION

This invention overcomes the disadvantages of the prior art by providing a three aspect signalling system that does not contain reflectors and hence does not produce phantom signals. The apparatus of this invention also does not include an expensive, difficult to maintain, moveable relay lens mechanism that is used for the production of red, yellow and green signals. Consequently, a lens mechanism will not be locked in one position by a vandal's projectile. Thus, the lamps and lenses of this invention may be so arranged that if lenses 13 and 26 and filter 25 were destroyed, this invention will produce no light or only white light. The aforementioned white light signal would indicate that a potentially dangerous condition may be present.

The apparatus of this invention includes: three lamps that emit white light; three collimated lenses (one lens for each lamp) that are used to gather the light output of a specific lamp and produce a parallel white light beam; two dichroic morrors that function as a dichroic mirror and a dichroic filter (the dichroic filter portion of the mirror passes light of the desired wave lengths i.e., red, yellow or green light and the dichroic mirror portion reflects the remaining light into the side of the signed housing away from the output lenses) and two output lenses that disperse the colored light signal so that it may be seen at great distances.

It is an object of this invention to provide a new and improved signalling device.

It is another object of this invention to provide a new and improved light signalling device that does not produce phantom signals.

It is a further object of this invention to provide a new and improved three aspect signalling system that has no moving parts.

Other objects and advantages of this invention will become apparent as the following description proceeds, which invention should be considered together with the accompanying drawings.

DESCRIPTION OF THE PREFERRED EMBODIMENT

Figure 1:
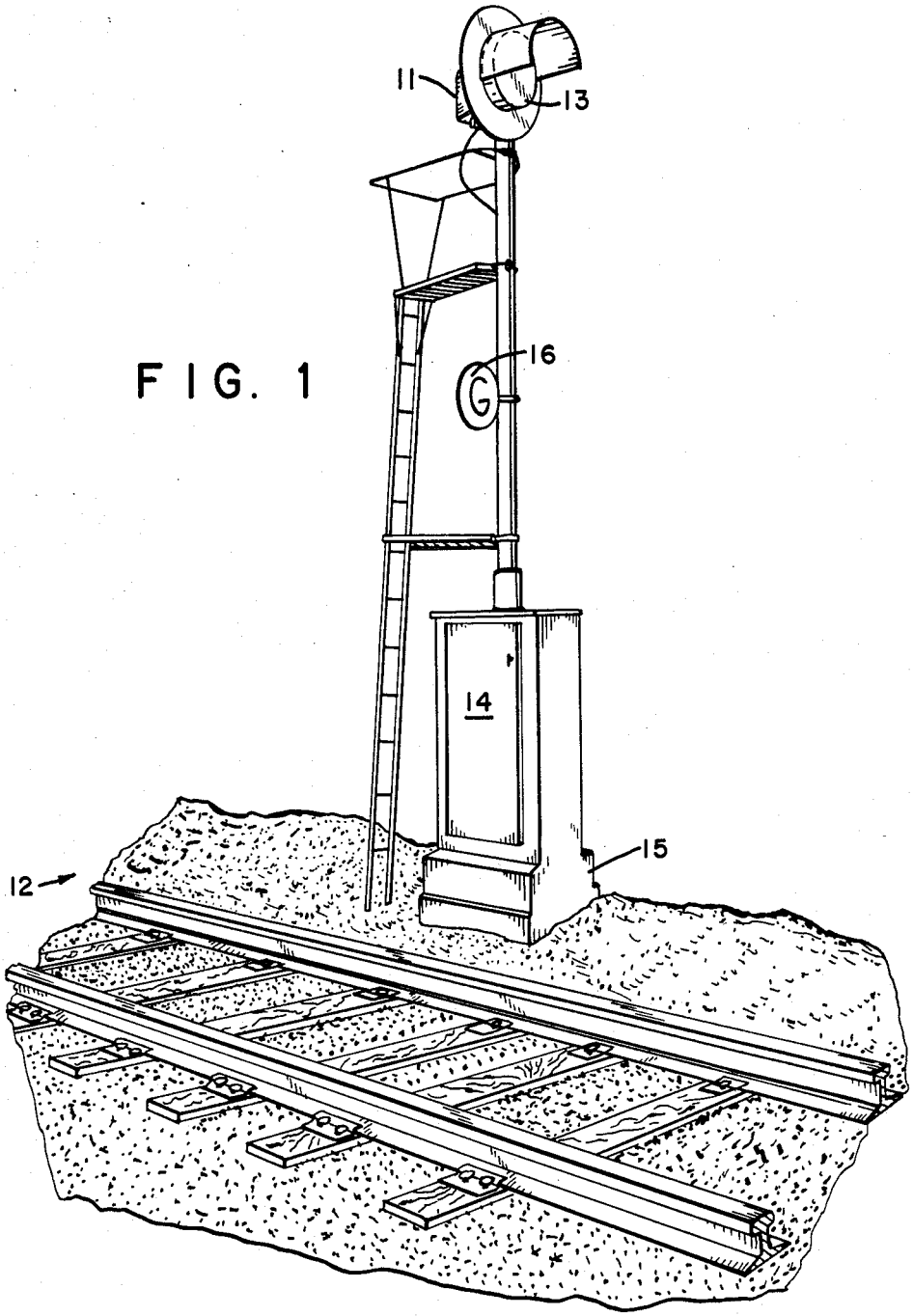
FIG. 1 is a perspective representation showing the apparatus of this invention at a railroad siding.
Figure 2:
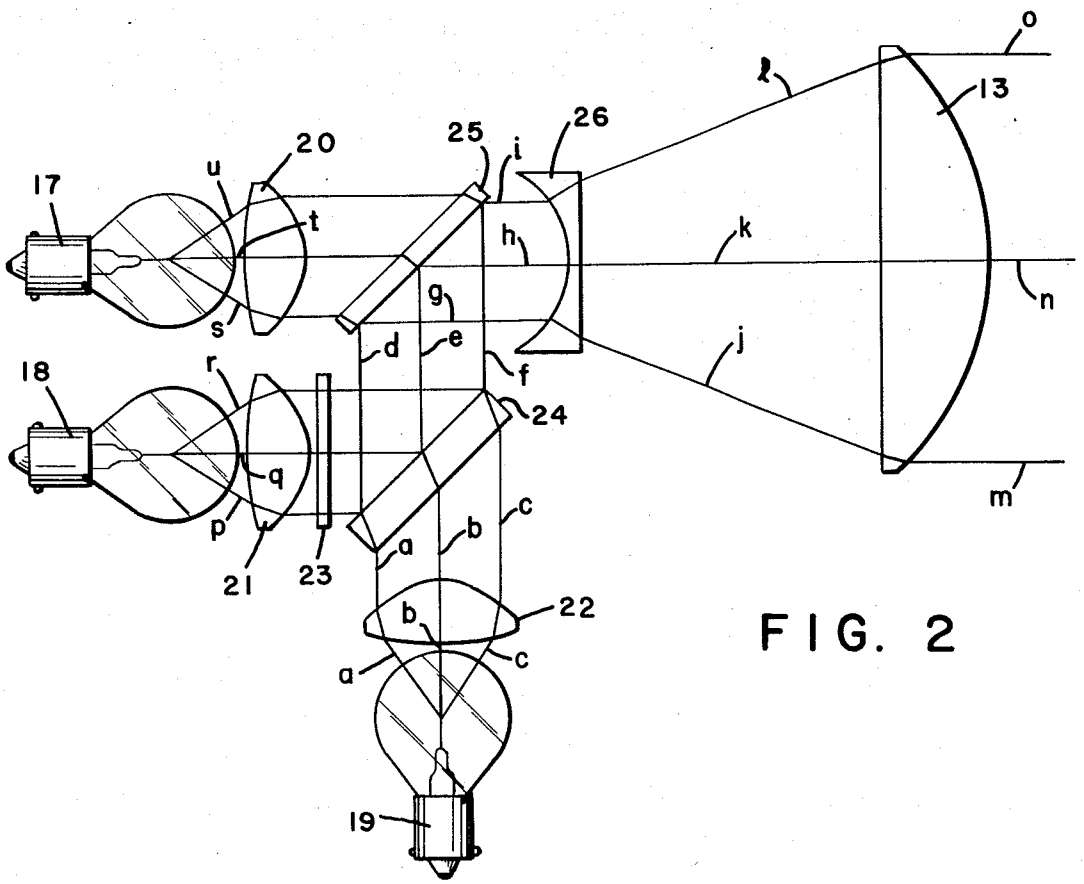
FIG. 2 is a pictorial representation of the apparatus of this invention.

Referring now to the drawings in detail, and more particularly to FIG. 1, the referenced character II represents a railroad signalling device II positioned along side railroad track 12. Signalling device II, includes an output lens 13 that disperses light signals, and the remainder of the apparatus of this invention which is shown in FIG. 2. Output lens 13 and the apparatus of this invention is connected to housing 14 and housing 14 rests on base 15. A sign 16 containing information identifying the location of device II is connected to housing 14 and base 15.

FIG. 2 shows the apparatus of this invention. Lamps 17, 18 and 19 radiate white light. Lamps 17, 18 and 19 may be any source of white light that radiates a sufficient amount of white light for instance Standard American Association of Railroad White Light Bulbs may be used. Collimator lens 20 is positioned in front of lamp 17 and collimator lens 21 is positioned in front of lamp 18, and collimator lens 22 is positioned in front of lamp 19. Lenses 20, 21 and 22 may be Melles Griot model 01 LAG 009 lenses. Melles Griot is located at 1770 Kettering Street, Irvine, Calif. 92714. Green filter 23 is positioned in front of lens 21. Filter 23 has optical characteristics similar to the Schott GG 435 filter. The Schott GG 435 filter is manufactured by Schott Optical Glass Incorporated, York Avenue, Duryea, Pa. 18642. Dichroic mirror/dichroic filter 24 is positioned between filter 23 and lens 22. Mirror/filter 24 has optical characteristics similar to the Schott OG 550 dichroic mirror/- filter. Dichroic mirror/dichroic filter 25 is positioned above mirror/filter 24 and between lens 20 and concave output lens 26. Mirror/filter 25 has optical characteristics similar to the Schott RG 610 dichroic mirror/dichroic filter and lens 26 has optical characteristics similar to the Melles Groit 01 LPK 023 lens. Concave output lens 13 is positioned in front of lens 26 so that it will be able to disperse the light output of lens 26. Lens 13 may be any collimator lens similar to GRS P/N 54249-6. The aforementioned lens is sold by the assignee of this invention.

The theory of operation of the apparatus of this invention is that either lamp 17, 18 or 19 will be energized at any given time. The mechanism for energizing the lamps is old and well known in the art as shown in FIG. 209, page 206 of Elements of Railway Signalling, pamphlet 1979, published by General Railway Signal, a unit of General Signal. If the apparatus of this invention wanted lens 13 to output yellow light, lamp 19 would be energized. Lens 22 will collimate a portion of the lamp light represented by rays a, b, and c produced by lamp 19 and direct them to the surface of mirror/filter 24. Dichroic mirror/dichroic filter 24 is designed to refract the yellow portion of the spectrum of rays a, b and c and reflect the remaining visible spectrum away from mirror/filter 24. Thus, the yellow frequencies of the light rays a, b and c will travel via paths d, e and f to the surface of mirror/filter 25. Mirror/filter 25 will reflect the yellow light transmitted via paths d, e and f to the surface of concave output lens 26 via paths g, h and i. Lens 26 will refract the yellow light transmitted via paths g, h and i and expand the beam pattern of the foregoing yellow light beam to cover the surface of concave output lens 13. Hence, yellow light rays a, b and c will now be transmitted from lens 26 to lens 13 via paths j, k and l. Lens 13 will refract the light transmitted via paths j, k and l and transmit yellow light rays a, b and c in the direction represented by rays m, n and o. Thus, lens 13 will output a generally collimated beam of yellow light that may be seen at distances greater than one mile. Note: In all three cases because the light source is finite, the output beam will normally contain some convergent and divergent light.

If the apparatus of this invention wanted lens 13 to output green light, lamp 18 would be energized. Lens 21 will collimate light represented by rays p, q and r produced by lamp 18 and direct them to the surface of green filter 23, Filter 23 will filter the white light produced by lamp 18 so that the rays p, q and r passing thru filter 23 will only contain light having frequencies in the green portion of the spectrum. Rays p, q and r will be reflected by mirror/filter 24 and travel via paths d, e and f to the surface of mirror/filter 25. Mirror/filter 25 will reflect rays p, q and r and transmit the aforementioned rays via paths g, h and i to the surface of concave lens 26. Lens 26 will refract the green light transmitted via paths g, h and i and expand the beam pattern of the foregoing green light so that when it travels via paths j, k and l it will cover the surface of lens 13. Lens 13 will refract the light transmitted via paths j, k and l and transmit green light rays p, q and r in the direction indicated by rays m, n and o. Thus, lens 13 will output a collimated beam of green light that may be seen at distances greater than one mile.

In the event the apparatus of this invention wanted lens 13 to output red light, lamp 17 would be energized. Lens 20 would collimate light represented by rays s, t and u produced by lamp 17 and direct the aforementioned rays to the surface of dichroic mirror/dichroic filter 25. Mirror/filter 25 is designed to refract the red portion of the spectrum of rays s, t and u through it and reflect the remaining visible spectrum away from mirror/filter 25. The light rays s, t and u containing red light will travel via paths g, h and i to the surface of lens 26. Lens 26 will refract the red light transmitted via paths g, h and i and expand the beam pattern of the foregoing red light beam to cover the surface of concave output lens 13. Hence, red light rays s, t and u will now be transmitted from lens 26 to lens 13 via paths j, k and l. Lens 13 will refract the light transmitted via paths j, k and l and transmit red light rays s, t and u in a direction indicated by rays m, n and o. Thus, lens 13 will output a collimated beam of red light that may be seen at distances greater than one mile.

One of the reasons that the components of the preferred embodiment were arrnged in the foregoing manner is that if a projectile was propelled through lens 13 and lens 26, lenses 13 and 26 may be destroyed and if the projectile did damage mirror/filter 25, mirror/filter 25 would be unable to reflect the yellow and green light signals reflected by mirror/filter 24. Thus, when mirror/filter 25 is destroyed the apparatus of this invention would be only able to display the white light produced by lamp 17. Hence, an engineer would know that there is something wrong with the signal coming from lens 13 and he would be able to take appropriate action.

The above specification describes a new and improved three aspect signalling system that may be used to display signals. It is realized that the above description may indicate to those skilled in the art additional ways in which the principals of this invention may be used without departing from its spirit. It is therefore, intended that this invention be limited only by the scope of the appended claims.

What is claimed is:

1. A three color aspect signalling system which only displays one color at a time, said system has three sources of white light which are contained in a housing, and are individually illuminated at different times, said system comprising:

means for individually directing the light output of each of said white light sources;

a first mirror/filter positioned in front of said directing means so that said mirror/filter will transmit only a selected frequency band of the light received from said first source of white light and said mirror/filter will reflect the remaining frequency bands of white light into the side of said housing where it will be absorbed;

a second mirror/filter positioned in front of said directing means and in front of said first mirror/filter to enable said second mirror/filter to transmit only a selected specific frequency band of the light received from said second source of white light and to reflect the remaining frequency bands of white light into the side of said housing where it will be abandoned; said second mirror/filter will also reflect the light received from said first mirror/filter;

means for filtering, positioned in front of said directing means and said third light source so that said filtering means will only direct light of a specified band of frequencies to the reflecting surface of said first mirror/filter such that the light will be reflected towards the said second mirror/filter; and focusing means positioned in front of said second mirror/filter for projecting the colored light signals received from said second mirror/filter so that they may be seen at a distance from said focusing means.

2. The system claimed in claim 1 wherein said first mirror/filter is a first dichroic mirror/dichroic filter.

3. The system claimed in claim 2 wherein said second mirror/filter is a second dichroic mirror/dichroic filter.

4. The system claimed in claim 3 wherein said focusing means comprises:

a first output lens that disperses the output beam received from said second dichroic mirror/filter; and a second output lens that collimates the output beam received from said first output lens.

5. The system claimed in claim 3 wherein said filtering means is a filter.

6. The system claimed in claim 1 wherein said means for directing comprises:

a first collimator lens positioned in front of said first light source for directing the light output of said first light source;

a second collimator lens positioned in front of said second light source for directing the light output of said second light source; and a third collimator lens positioned in front of said third light source for directing the light output of said third light source.

* * * * *